US006945731B1

(12) United States Patent
Vait

(10) Patent No.: US 6,945,731 B1
(45) Date of Patent: Sep. 20, 2005

(54) SUBTERRANEAN UTILITY MARKER

(76) Inventor: Randy T. Vait, 19247 County Rd. 44, Clearwater, MN (US) 55320

( * ) Notice: Subject to any disclaimer, the term of this patent is extended or adjusted under 35 U.S.C. 154(b) by 0 days.

(21) Appl. No.: 11/094,556

(22) Filed: Mar. 31, 2005

(51) Int. Cl.[7] ..... G09F 15/00

(52) U.S. Cl. ..... 404/10; 404/25; 116/63 R; 116/173; 40/608; 40/612; 248/156; 248/560

(58) Field of Search ..... 404/9, 10, 25; 116/63 R, 63 P, 173; 40/606.01, 607.05, 40/608, 612; 248/548, 560, 156; 52/19, 20

(56) References Cited

U.S. PATENT DOCUMENTS

| | | | | | |
|---|---|---|---|---|---|
| 2,193,747 | A | * | 3/1940 | Thompson | 116/175 |
| 2,254,566 | A | * | 9/1941 | Cornell, Jr. | 464/57 |
| 3,044,435 | A | * | 7/1962 | Reardon | 116/209 |
| 3,067,717 | A | * | 12/1962 | Imparato | 116/173 |
| 3,198,362 | A | | 8/1965 | Berg | |
| 3,241,516 | A | * | 3/1966 | Hopkins | 116/173 |
| 3,878,810 | A | * | 4/1975 | Conrad | 116/28 R |
| 4,161,723 | A | * | 7/1979 | De Vittori | 340/323 R |
| 4,636,109 | A | * | 1/1987 | Clausen et al. | 404/10 |
| 4,676,015 | A | * | 6/1987 | Stoudt | 40/608 |
| D290,822 | S | * | 7/1987 | McEntee | D11/166 |
| 4,691,892 | A | * | 9/1987 | Grewe et al. | 248/624 |
| 5,092,556 | A | * | 3/1992 | Darling et al. | 248/519 |
| D350,084 | S | | 8/1994 | Willis et al. | |
| 5,623,971 | A | | 4/1997 | Foernzler | |
| 5,862,772 | A | * | 1/1999 | Yancey et al. | 114/357 |
| 5,964,401 | A | * | 10/1999 | Thill | 232/35 |
| 6,129,035 | A | | 10/2000 | Schweinberger | |
| 6,347,600 | B1 | | 2/2002 | Duff, II | |
| 6,349,667 | B1 | | 2/2002 | Rogers et al. | |
| 6,378,453 | B1 | * | 4/2002 | Conway | 116/28 R |
| 6,623,368 | B1 | * | 9/2003 | Levi | 472/118 |

* cited by examiner

*Primary Examiner*—Gary S. Hartmann

(57) ABSTRACT

A flag assembly includes an elongated and rectilinear shaft having opposed end portions situated adjacent a ground surface. The shaft includes a banner attached to one of the end portions having surface indicia imprinted thereon. A protective cover member is provided with a centrally registered countersunk bore situated therebelow. A frusto-conical spring member having axially opposed first and second end portions is conjoined to another end portion of the shaft and extends downwardly away therefrom along a vertical plane respectively. A bushing having a monolithically formed lower portion provided with a tapered diameter is inwardly offset from a diameter of the shaft. The bushing further has an axially registered upper portion operably conjoined to the spring member and cooperating with the shaft such that the spring member can be resiliently adapted between compressed and equilibrium positions to absorb vertically channeled impact forces encountered during installation procedures.

15 Claims, 6 Drawing Sheets

SUBTERRANEAN UTILITY MARKER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to physical location indicator devices and more particularly, to a subterranean utility marker for identifying utility valves and manhole covers.

2. Prior Art

It is commonplace to install utilities prior to the commencement or very early in the commencement of construction at a construction site. These utilities are exposed to various hazards throughout the construction process. Such utilities include, but are not limited to, water meter pits, water valve pits, natural gas shut off valves, electric pedestals, communication pedestals, and sewer manholes. Other hazards, such as deep holes, hazardous materials, or equipment may also be in danger of damage or causing injury. Such devices and utilities are very difficult to see as they are at ground level, and are also very easy to damage.

The most common form of damage occurs when a vehicle, construction machine, or delivery truck impact the utility. It has been determined that a need to indicate the location of such a ground based structure is required. Damage occurs when the utility is impacted by construction machinery, delivery trucks, and other vehicles on the job site.

Accordingly, a need remains for a physical location identifying apparatus that overcomes the above-noted shortcomings. The present invention satisfies such a need by providing a flag assembly which, when properly positioned, alerts construction and utility workers, as well as passerbys, to the location of underground utilities and manhole covers. The present invention provides a highly visible indicator of the location of such public utilities, thereby minimizing the risk of them being damaged during the course of backfilling and related operations.

BRIEF SUMMARY OF THE INVENTION

In view of the foregoing background, it is therefore an object of the present invention to provide an apparatus for identifying subterranean utility valves and manhole covers. These and other objects, features, and advantages of the invention are provided by a flag assembly including an elongated and rectilinear shaft formed from fiberglass and having opposed end portions situated adjacent a ground surface and axially displaced at a predetermined height thereabove respectively.

The shaft preferably includes a banner attached to one of the end portions and may have surface indicia imprinted thereon for identifying a location unique to one of the utility valves and manhole covers. The surface indicia preferably includes a primary color associated with public sewer and water systems respectively. The surface indicia may further include a secondary color for further defining one of a storm and sanitary category associated with the public sewers systems.

A protective cover member is removably positional over one of the utility valves and manhole covers and is provided with a centrally registered countersunk bore situated therebelow. A frusto-conical spring member having axially opposed first and second end portions is conjoined to another end portion of the shaft and extends downwardly away therefrom along a vertical plane respectively. Such a spring member is compressible along a vertical axis registered with the countersunk bore.

The flag assembly further includes a bushing having a monolithically formed lower portion provided with a tapered diameter inwardly offset from a diameter of the shaft. The bushing further has an axially registered upper portion operably conjoined to the spring member and cooperating with the shaft such that the spring member can be resiliently adapted between compressed and equilibrium positions to absorb vertically channeled impact forces encountered during installation procedures. The bushing lower portion is threadably insertable into the countersunk bore so that the shaft can be maintained at a substantially stable position during inclement weather conditions.

The cover member is preferably selected from the group including a manhole cover and a T-shaped curb stop. Each manhole cover and T-shaped curb stop are preferably provided with substantially planar top surfaces registered flush with the ground surface.

The assembly preferably further includes a magnet engaged with the cover member and provided with a central aperture vertically aligned with the countersunk bore in such a manner that the bushing lower portion is vertically insertable into the magnet for stability during inclement weather conditions. The magnet preferably further comprises a non-magnetic shield positioned over a top surface of the magnet for prohibiting undesirable foreign debris from adhering to the magnet.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
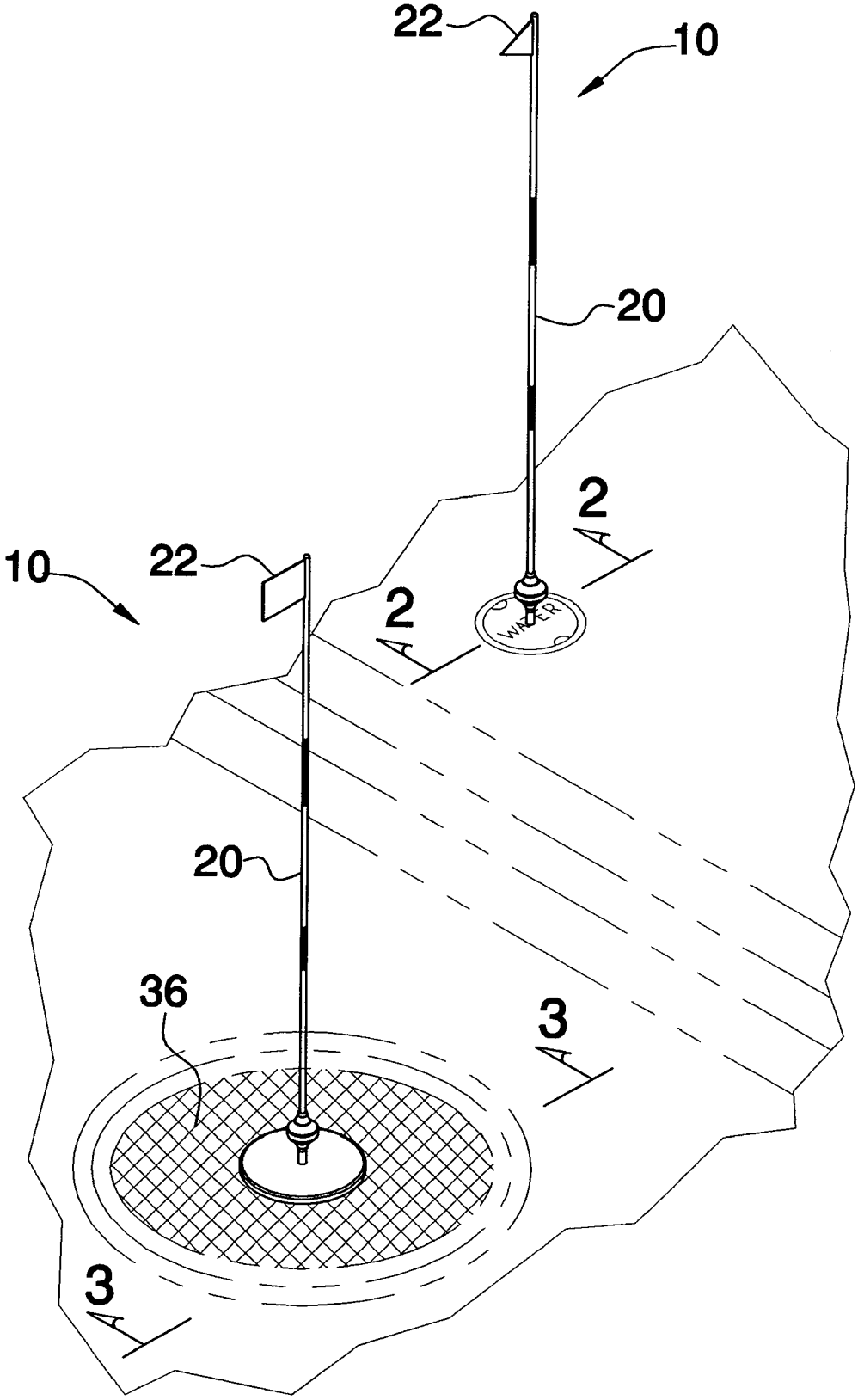
FIG. 1 is a perspective view showing a flag assembly identifying a manhole cover and a water utility valve respectively.
Figure 2:
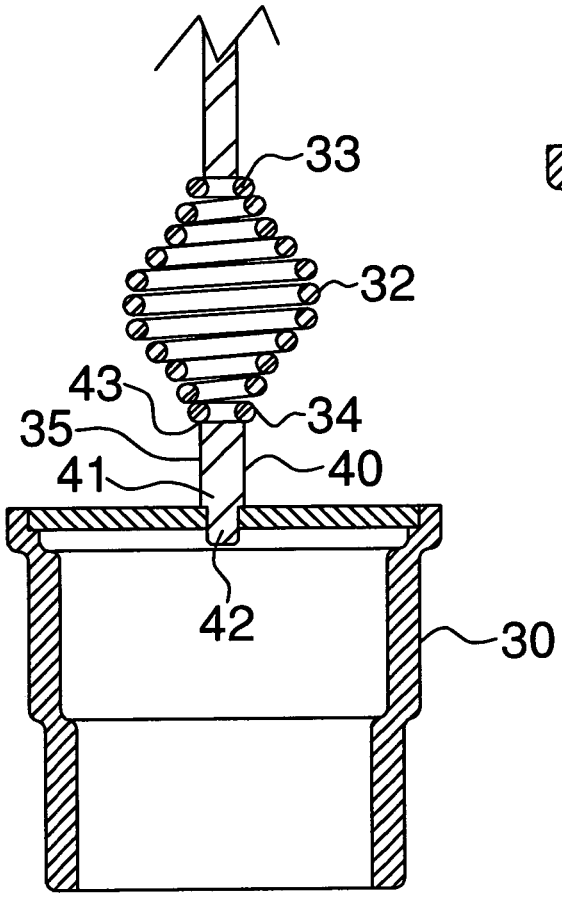
FIG. 2 is a cross-sectional view of the cover member and the spring member shown in FIG. 1, taken along line 2—2.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–8 by the reference numeral 10 and is intended to provide an apparatus for identifying subterranean utility valves and manhole covers. It should be understood that the flag assembly 10 may be used to identify many different types of subterranean objects and should not be limited to identifying only utility valves and manhole covers.

Figure 4:
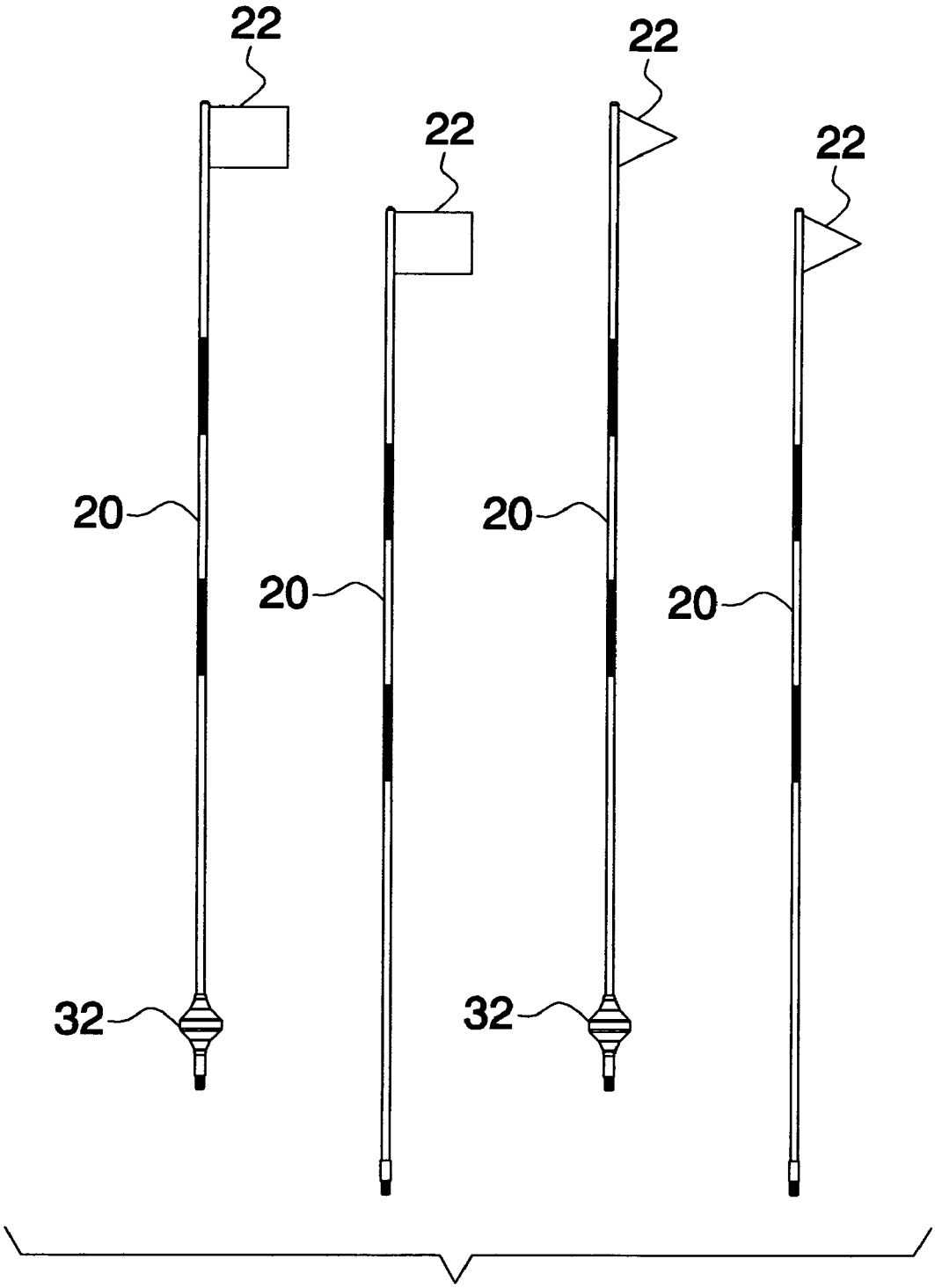
FIG. 4 is a front elevational view of the present invention showing the banners for utility valves and manhole covers.

Referring initially to FIGS. 1 and 4, the flag assembly 10 includes an elongated and rectilinear shaft 20 preferably formed from fiberglass and having opposed end portions 21 situated adjacent a ground surface and axially displaced at a predetermined height thereabove respectively. Of course, such a shaft 20 may be formed from wood, aluminum, plastic or steel, as is obvious to one having ordinary skill in the art. The shaft 20 preferably includes a banner 22 attached to one of the end portions 21 and may have surface indicia imprinted thereon for identifying a location unique to one of the utility valves and manhole covers.

Figure 8:
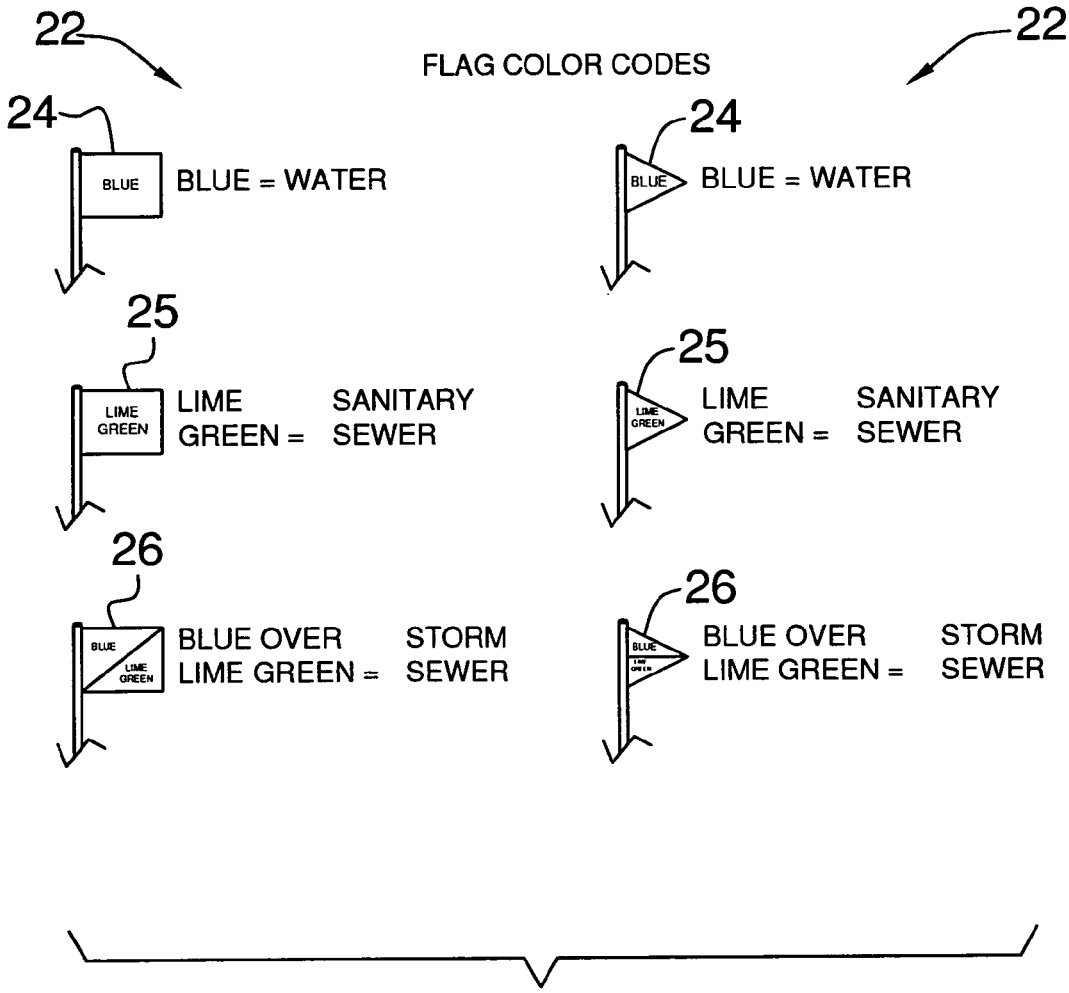
FIG. 8 is a front elevational view illustrating the various surface indicia for identifying public sewer and water systems.

Such a banner preferably has a rectangular or pennant shape, as well known in the industry, but may have other shapes as is obvious to one having ordinary skill in the art. The surface indicia may include a primary color 24 associated with public sewer and water systems respectively and a secondary color 25 for further defining one of a storm and sanitary category associated with the public sewers systems, as shown in FIG. 8. The primary color 24 is preferably blue and the secondary color 25 is preferably lime green, but other colors may also be used as well known in the industry. A combination of the two colors 26 may also be used to identify storm sewers. Such banners 22 make it easy for the operator of heavy equipment to identify the location of the utilities, preventing damage and minimizing risk during the course of backfilling and related operations.

Figure 5:
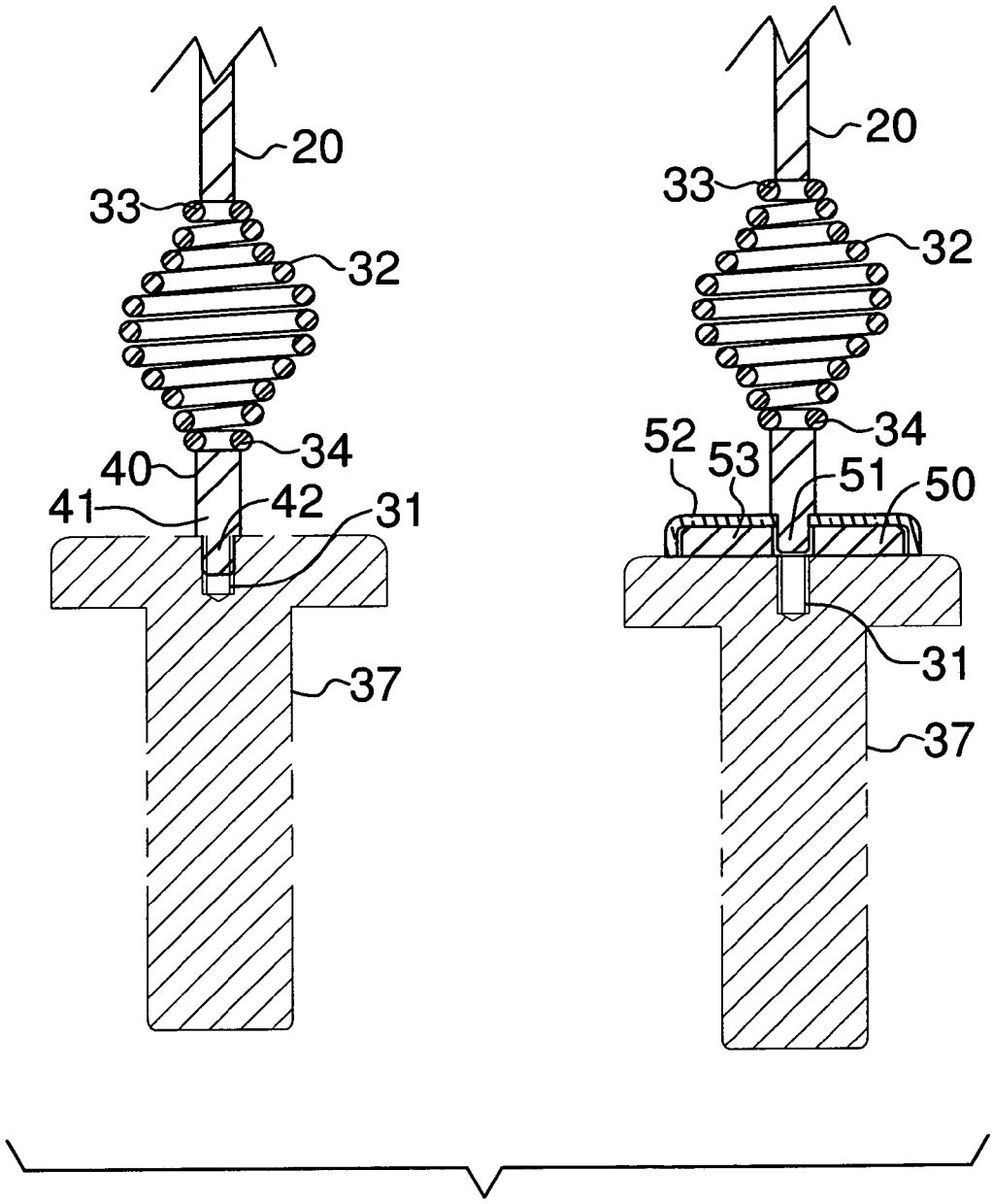
FIG. 5 is a cross-sectional view showing the present invention positioned atop a T-shaped curb stop not including a magnet, and including a magnet, respectively.

Referring to FIGS. 1–7, a protective cover member 30 is removably positional over one of the utility valves and manhole covers and is provided with a centrally registered countersunk bore 31 situated therebelow, as shown in FIG. 5. A frusto-conical spring member 32 having axially opposed first 33 and second 34 end portions is conjoined to another end portion 35 of the shaft 20 and extends downwardly away therefrom along a vertical plane respectively. Such a spring member 32 is compressible along a vertical axis registered with the countersunk bore 31. The spring member 32 provides stability to the shaft 20 while allowing same to flex during windy conditions or when struck by a piece of equipment to prevent damage.

Referring to FIGS. 2,3, 5, 6, and 7, the flag assembly 10 further includes a bushing 40 having a monolithically formed lower portion 41 provided with a tapered diameter 42 inwardly offset from a diameter of the shaft 20. The bushing 40 further has an axially registered upper portion 43 operably conjoined to the spring member 32 and cooperating with the shaft 20 such that the spring member 32 can be resiliently adapted between compressed and equilibrium positions to absorb vertically channeled impact forces encountered during installation procedures. The bushing 40 lower portion 41 is threadably insertable into the countersunk bore 31 so that the shaft 20 can be maintained at a substantially stable position during inclement weather conditions. Such a bushing 40 is preferably sized and shaped to fit the most common utility covers, although the bushing 40 may be sized and shaped to fit many different sizes of covers.

Referring to FIGS. 1, and 4–6, the cover member 30 is selected from the group including a manhole cover 36 and a T-shaped curb stop 37. The manhole cover 36 and T-shaped curb stop 37 are provided with substantially planar top surfaces registered flush with the ground surface.

Figure 6:
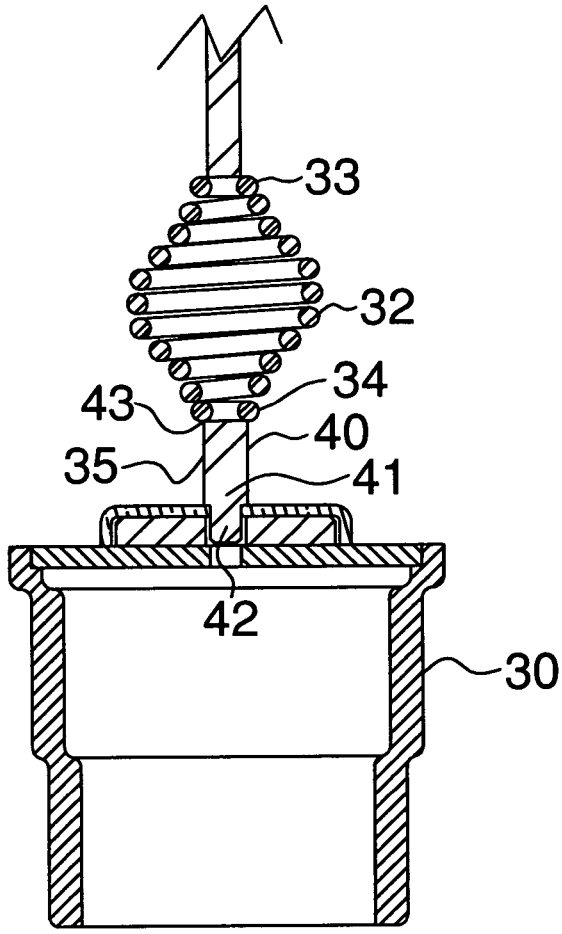
FIG. 6 is a cross-sectional view showing the present invention positioned atop a gate valve cover and including a magnet.
Figure 7:
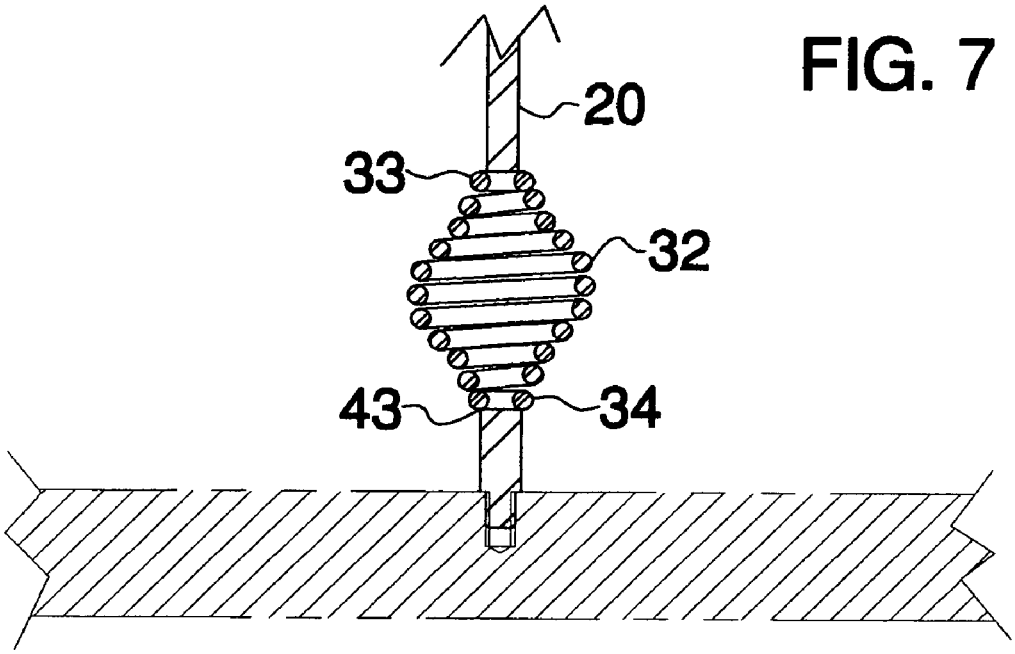
FIG. 7 is a cross-sectional view of the bushing and spring member shown in FIG. 3 with the magnet.
Figure 3:
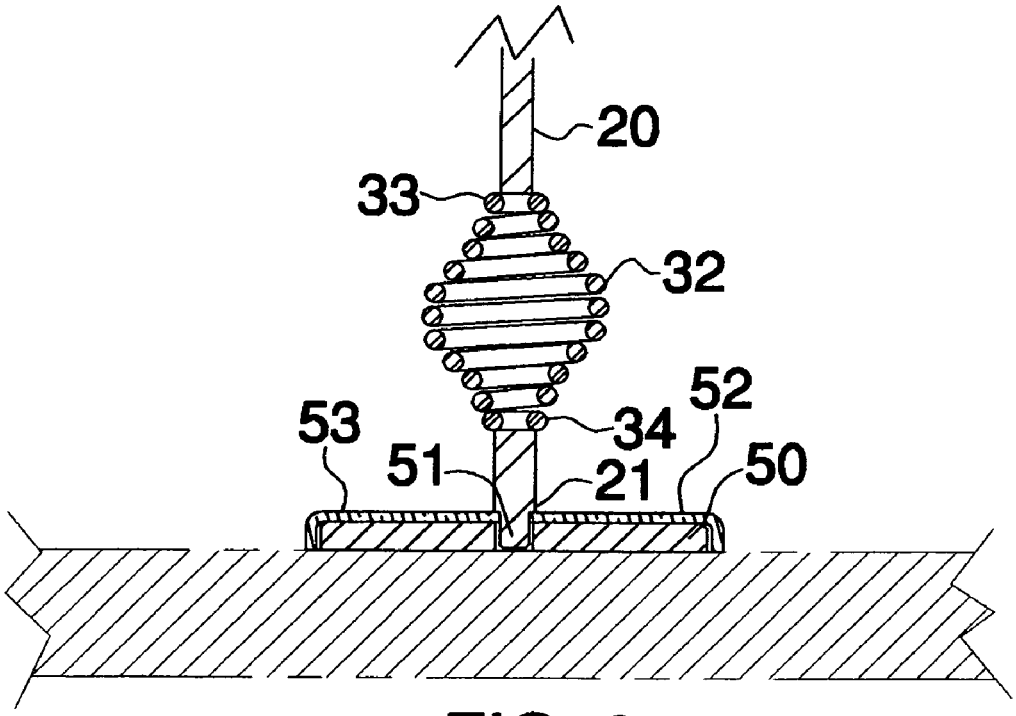
FIG. 3 is a cross-sectional view of the bushing and the spring member shown in FIG. 1, taken along line 3—3.

Referring to FIGS. 3, 5, and 6, the assembly 10 preferably further includes a magnet 50 engaged with the cover member 30 and provided with a central aperture 51 vertically aligned with the countersunk bore 31 in such a manner that the bushing 40 lower portion 41 is vertically insertable into the magnet 50 for stability during inclement weather conditions. It is critical that the bushing 40 be inserted into, not through, the magnet 50 such that it stops at a bottom surface of the magnet 50 and is not inserted into a top surface of a gate valve curb stop or manhole cover because doing so would defeat the purpose of using the magnet 50. The magnet 50 preferably further comprises a non-magnetic shield 52 positioned over a top surface 53 of the magnet 50 for prohibiting undesirable foreign debris from adhering to the magnet 50. The magnet 50 allows a user to easily and quickly remove the flag assembly 10 when no longer needed, or to transport to a remote location.

The flag assembly 10 provides a highly visible indicator of the location of utility valves or manholes, thereby minimizing the risk of them being damaged during the construction or repair process. Such an assembly 10 is easy to install, durable, and easily removed. Such a flag assembly 10 provides a contractor or governmental unit with improved safety and increased efficiency that results in time and cost savings.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A flag assembly for identifying subterranean utility valves and manhole covers, said flag assembly comprising:

an elongated and rectilinear shaft having opposed end portions situated adjacent a ground surface and axially displaced at a predetermined height thereabove respectively, said shaft including a banner attached to one said end portions and having surface indicia imprinted thereon for identifying a location unique to one of the utility valves and manhole covers, said surface indicia including a primary color associated with public sewer and water systems respectively;

a protective cover member removably positional over one of the utility valves and manhole covers, said protective cover member being provided with a centrally registered countersunk bore situated therebelow;

a frusto-conical spring member having axially opposed first and second end portions conjoined to another said end portion of said shaft and extending downwardly away therefrom along a vertical plane respectively; and a bushing having a monolithically formed lower portion provided with a tapered diameter inwardly offset from a diameter of said shaft, said bushing further having an axially registered upper portion operably conjoined to said spring member and cooperating with said shaft such that said spring member can be resiliently adapted between compressed and equilibrium positions to absorb vertically channeled impact forces encountered during installation procedures, said bushing lower portion being threadably insertable into said countersunk bore so that said shaft can be maintained at a substantially stable position during inclement weather conditions.

2. The flag assembly of claim 1, wherein said cover member is selected from the group comprising: a manhole cover and a T-shaped curb stop, each said manhole cover and T-shaped curb stop are provided with substantially planar top surfaces registered flush with the ground surface.

3. The flag assembly of claim 1, further comprising: a magnet engaged with said cover member and provided with a central aperture vertically aligned with said countersunk bore in such a manner that said bushing lower portion is vertically insertable into said magnet for stability during inclement weather conditions.

4. The flag assembly of claim 1, wherein said surface indicia includes a secondary color for further defining one of a storm and sanitary category associated with the public sewers systems.

5. The flag assembly of claim 3, wherein said magnet further comprises: a non-magnetic shield positioned over a top surface of said magnet for prohibiting undesirable foreign debris from adhering to said magnet.

6. A flag assembly for identifying subterranean utility valves and manhole covers, said flag assembly comprising:

an elongated and rectilinear shaft formed from fiberglass and having opposed end portions situated adjacent a ground surface and axially displaced at a predetermined height thereabove respectively, said shaft including a banner attached to one said end portions and having surface indicia imprinted thereon for identifying a location unique to one of the utility valves and manhole covers, said surface indicia including a primary color associated with public sewer and water systems respectively;

a protective cover member removably positional over one of the utility valves and manhole covers, said protective cover member being provided with a centrally registered countersunk bore situated therebelow;

a frusto-conical spring member having axially opposed first and second end portions conjoined to another said end portion of said shaft and extending downwardly away therefrom along a vertical plane respectively; and a bushing having a monolithically formed lower portion provided with a tapered diameter inwardly offset from a diameter of said shaft, said bushing further having an axially registered upper portion operably conjoined to said spring member and cooperating with said shaft such that said spring member can be resiliently adapted between compressed and equilibrium positions to absorb vertically channeled impact forces encountered during installation procedures, said bushing lower portion being threadably insertable into said countersunk bore so that said shaft can be maintained at a substantially stable position during inclement weather conditions.

7. The flag assembly of claim 6, wherein said cover member is selected from the group comprising: a manhole cover and a T-shaped curb stop, each said manhole cover and T-shaped curb stop are provided with substantially planar top surfaces registered flush with the ground surface.

8. The flag assembly of claim 6, further comprising: a magnet engaged with said cover member and provided with a central aperture vertically aligned with said countersunk bore in such a manner that said bushing lower portion is vertically insertable into said magnet for additional stability during inclement weather conditions.

9. The flag assembly of claim 6, wherein said surface indicia includes a secondary color for further defining one of a storm and sanitary category associated with the public sewers systems.

10. The flag assembly of claim 8, wherein said magnet further comprises: a non-magnetic shield positioned over a top surface of said magnet for prohibiting undesirable foreign debris from adhering to said magnet.

11. A flag assembly for identifying subterranean utility valves and manhole covers, said flag assembly comprising:

an elongated and rectilinear shaft formed from fiberglass and having opposed end portions situated adjacent a ground surface and axially displaced at a predetermined height thereabove respectively, said shaft including a banner attached to one said end portions and having surface indicia imprinted thereon for identifying a location unique to one of the utility valves and manhole covers, said surface indicia including a primary color associated with public sewer and water systems respectively;

a protective cover member removably positional over one of the utility valves and manhole covers, said protective cover member being provided with a centrally registered countersunk bore situated therebelow;

a frusto-conical spring member having axially opposed first and second end portions conjoined to another said end portion of said shaft and extending downwardly away therefrom along a vertical plane respectively, said spring member being compressible along a vertical axis registered with said countersunk bore; and a bushing having a monolithically formed lower portion provided with a tapered diameter inwardly offset from a diameter of said shaft, said bushing further having an axially registered upper portion operably conjoined to said spring member and cooperating with said shaft such that said spring member can be resiliently adapted between compressed and equilibrium positions to absorb vertically channeled impact forces encountered during installation procedures, said bushing lower portion being threadably insertable into said countersunk bore so that said shaft can be maintained at a substantially stable position during inclement weather conditions.

12. The flag assembly of claim 11, wherein said cover member is selected from the group comprising: a manhole cover and a T-shaped curb stop, each said manhole cover and T-shaped curb stop are provided with substantially planar top surfaces registered flush with the ground surface.

13. The flag assembly of claim 11, further comprising: a magnet engaged with said cover member and provided with a central aperture vertically aligned with said countersunk bore in such a manner that said bushing lower portion is vertically insertable into said magnet for stability during inclement weather conditions.

14. The flag assembly of claim 11, wherein said surface indicia includes a secondary color for further defining one of a storm and sanitary category associated with the public sewers systems.

15. The flag assembly of claim 13, wherein said magnet further comprises: a non-magnetic shield positioned over a top surface of said magnet for prohibiting undesirable foreign debris from adhering to said magnet.

* * * * *